US011017912B2

(12) United States Patent
Kim et al.

(10) Patent No.: US 11,017,912 B2
(45) **Date of Patent: *May 25, 2021**

(54) X-RAY SHUTTER APPARATUS AND X-RAY SHUTTER OPENING AND CLOSING SYSTEM USING THE SAME

(71) Applicant: POSTECH ACADEMY-INDUSTRY FOUNDATION, Pohang-si (KR)

(72) Inventors: Hyo Yun Kim, Pohang-si (KR); Hee Seob Kim, Pohang-si (KR); Jun Lim, Pohang-si (KR); Dong Tak Jeong, Pohang-si (KR); Sang Sul Lee, Pohang-si (KR); Jong Hyun Kim, Pohang-si (KR)

(73) Assignee: Rostech Academy-industry Foundation, Pohang-si (KR)

( * ) Notice: Subject to any disclaimer, the term of this patent is extended or adjusted under 35 U.S.C. 154(b) by 177 days.

This patent is subject to a terminal disclaimer.

(21) Appl. No.: 16/287,977

(22) Filed: Feb. 27, 2019

(65) Prior Publication Data

US 2019/0267148 A1 Aug. 29, 2019

(30) Foreign Application Priority Data

Feb. 27, 2018 (KR) ..... 10-2018-0024021

(51) Int. Cl.
*G21K 1/04* (2006.01)

(52) U.S. Cl.
CPC ..... *G21K 1/04* (2013.01)

(58) Field of Classification Search
CPC ..... G21K 1/04
See application file for complete search history.

(56) References Cited

U.S. PATENT DOCUMENTS

| | | | | | |
|---|---|---|---|---|---|
| 3,767,931 | A * | 10/1973 | Williams | A61B 6/08 | 378/153 |
| 3,934,151 | A * | 1/1976 | Stowe | A61B 6/06 | 378/160 |
| 4,071,771 | A * | 1/1978 | Covic | A61B 6/06 | 378/160 |
| 4,143,273 | A * | 3/1979 | Richey | A61B 6/032 | 378/150 |
| 5,107,530 | A * | 4/1992 | Allison | G21K 1/04 | 250/233 |
| 5,396,534 | A * | 3/1995 | Thomas | G21K 1/04 | 378/147 |
| 2011/0242636 | A1* | 10/2011 | Viglione | G03B 9/10 | 359/234 |
| 2016/0211044 | A1* | 7/2016 | Haunschild | G21K 1/04 | |

* cited by examiner

*Primary Examiner* — Mark R Gaworecki
(74) *Attorney, Agent, or Firm* — Morgan, Lewis & Bockius LLP

(57) ABSTRACT

The subject technology provides an X-ray shutter apparatus and an X-ray shutter opening and closing system using the same. An X-ray shutter apparatus may be configured to open or close an X-ray shutter using a magnetic field and to accurately control opening and closing of the X-ray shutter using an optical sensor. An X-ray shutter may include a fixing plate, a solenoid fixing block, a frame, a magnet, stop blocks and an exposed block. An X-ray shutter opening and closing system may use an X-ray shutter apparatus.

20 Claims, 7 Drawing Sheets

CLOSED

OPEN

X-RAY SHUTTER APPARATUS AND X-RAY SHUTTER OPENING AND CLOSING SYSTEM USING THE SAME

CROSS-REFERENCE TO RELATED APPLICATION

This application claims priority to and the benefit of Korean Patent Application No. 10-2018-0024021, filed on Feb. 27, 2018, the disclosure of which is incorporated herein by reference in its entirety.

BACKGROUND

1. Field of the Invention

The present disclosure relates to an X-ray shutter apparatus and an X-ray shutter opening and closing system using the same, and more particularly, to an X-ray shutter apparatus configured to open or close an X-ray shutter using a magnetic field and to accurately control opening and closing of the X-ray shutter using an optical sensor and an X-ray shutter opening and closing system using the same.

2. Discussion of Related Art

An X-ray shutter is an apparatus used to control emission of X-rays and generally operates in a mechanical operating manner to open and close a path of the X-rays.

Conventionally, an X-ray measuring system configured to control emission of X-rays by rotating an X-ray blocking unit through a blocking circuit electrically connected thereto and a driving method thereof are disclosed.

However, in a case of an X-ray shutter configured to operate only in a mechanically limited range like a conventional case, an opening and closing speed is limited due to a mechanical operating manner and an opening and closing time of a shutter is difficult to accurately control.

Accordingly, development of a technology capable of quickly opening and closing a shutter and accurately controlling an opening and closing state of the shutter using an electronic sensor is necessary.

(Patent Document 1) KR10-2011-0122960 A

SUMMARY OF THE INVENTION

The present disclosure is directed to providing an X-ray shutter apparatus configured to rotate an X-ray shutter by rotating a permanent magnet coupled to a frame according to a direction of a magnetic field generated from solenoids and open and close a path through which X-rays pass, and an X-ray shutter opening and closing system using the same.

According to an aspect of the present disclosure, there is provided an X-ray shutter apparatus including: a fixing plate; a solenoid fixing block in which upper surfaces of solenoids formed in a cylindrical shape having a hollow hole formed therein are coupled to inner side surfaces of both side surface portions spaced apart from each other and protruding in a C shape and in which an outer side surface of a middle end portion is fixed to one surface of the fixing plate; a frame in which a coupling portion formed at a part of the frame is fixed to the one surface of the fixing plate to be rotatably coupled to the fixing plate, a through portion in which a groove configured to pass through the inside thereof is formed is located on the coupling portion, and a covering plate is fixedly coupled to an end of a lower end portion; a permanent magnet inserted into the through portion to be seated in the groove and having both ends inserted into the hollow holes formed in the solenoids; a plurality of stop blocks fixedly coupled to the one surface of the fixing plate at locations spaced apart from each other with the lower end portion of the frame therebetween; and an exposed block fixed to the one surface of the fixing plate and in which a path is opened and closed by the covering plate when the frame rotates.

The permanent magnet may be laterally inserted into the through portion and the frame and the permanent magnet may form a T shape.

Only the coupling portion among the through portion, the coupling portion, and the lower end portion of the frame may come into contact with the fixing plate.

The solenoids may each have a lateral axial direction and may be coupled to the solenoid fixing block so that lower surfaces thereof face each other.

The frame may have a bolt coupled to a hole formed in the coupling portion and thus may be rotatably coupled to the one surface of the fixing plate.

X-rays may pass through the path when the path formed in the exposed block is opened.

The stop blocks may each include a buffer material attached to a portion which comes into contact with the frame configured to rotate between the stop blocks.

The X-ray shutter apparatus may further include sensor fixing blocks forming pairs with the stop blocks and fixedly coupled to the fixing plate at locations spaced apart from lower surfaces of the stop blocks by a predetermined distance on extending lines of vertical axes of the stop blocks which form the pair.

The sensor fixing blocks may be located between the covering plate and the lower surfaces of the stop blocks in the case in which the frame comes into contact with the stop blocks which form the pair.

Optical sensors configured to measure distances between the lower end portion of the frame and the sensor fixing blocks may be coupled to each of the sensor fixing blocks.

The X-ray shutter apparatus may further include a connector fixing block fixedly coupled to the one surface of the fixing plate and to which a connector configured to supply external power to the fixing plate is connected.

The frame may rotate together with the permanent magnet when the permanent magnet rotates due to a magnetic field generated when currents flow through the solenoids.

The frame may rotate in a clockwise direction or a counterclockwise direction according to a direction in which currents flow through the solenoids.

Directions of currents which flow through the solenoids may be opposite to each other.

According to another aspect of the present disclosure, there is provided an X-ray shutter opening and closing system including: the X-ray shutter apparatus; and a controller configured to adjust a direction of currents applied to the solenoids according to a signal which is input and determine whether the path formed in the exposed block is opened or closed on the basis of the direction of the currents and distances between optical sensors and the frame measured by the optical sensors.

The controller may adjust the direction of the currents applied to the solenoids to open or close the path formed in the exposed block when an opening signal or a closing signal of the path formed in the exposed block is received.

The controller may determine that the path formed in the exposed block is opened when the direction of the currents applied to the solenoids is a direction to open the path formed in the exposed block and the distances between the optical sensors and the frame measured by the optical sensor closer to the frame in the case in which the path formed in the exposed block is opened among the optical sensors are smaller than or equal to a predetermined distance.

The controller may determine that the path formed in the exposed block is closed when the direction of the currents applied to the solenoids is a direction to close the path formed in the exposed block and the distances between the optical sensors and the frame measured by the optical sensor closer to the frame in the case in which the path formed in the exposed block is closed among the optical sensors are smaller than or equal to a predetermined distance.

The predetermined distance may be a distance between the optical sensor closer to the stop block which comes into contact with the frame among the optical sensors and the frame when the lower end portion of the frame comes into contact with one of the stop blocks.

BRIEF DESCRIPTION OF THE DRAWINGS

Accompanying drawings included as a part of a detailed description for understanding the present disclosure provide embodiments of the present disclosure and describes technical features of the present disclosure with the detailed description.

DETAILED DESCRIPTION OF EXEMPLARY EMBODIMENTS

In the specification, terms "first" and/or "second" are used only used to distinguish one element from another. That is, the elements are not to be limited by the terms.

Elements, features, and steps mentioned to be "included" in the specification mean presence of the elements, features, and steps, and do not exclude one or more other elements, features, and steps and the equivalents.

The singular form is intended to also include the plural form, unless the context clearly indicates otherwise. That is, the elements mentioned in the specification may mean presence or addition of one or more other elements or the like.

Unless otherwise defined, all terms including technical or scientific terms used in the present disclosure have meanings the same as those of terms generally understood by those skilled in the art.

That is, it will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, an X-ray shutter apparatus according to an embodiment of the present disclosure and an X-ray shutter opening and closing system using the same will be described in detail with reference to the accompanying drawings.

Figure 1:
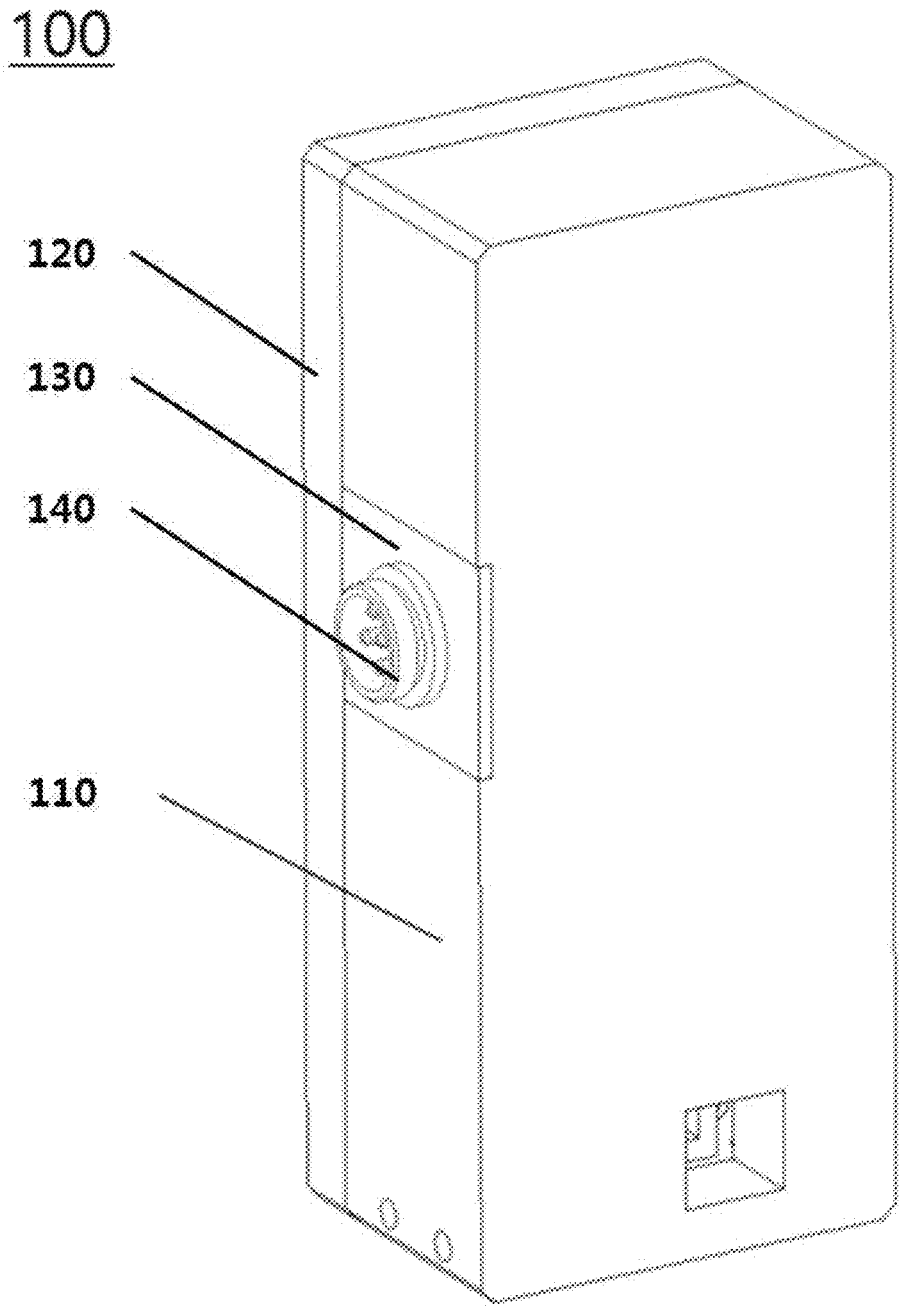
FIG. 1 is a view illustrating an exterior of an X-ray shutter apparatus according to an embodiment of the present disclosure.

FIG. 1 is a view illustrating an exterior of an X-ray shutter apparatus according to an embodiment of the present disclosure.

Referring to FIG. 1, an X-ray shutter apparatus 100 according to an embodiment of the present disclosure may include an outer cover 110, a fixing plate 120, a connector fixing block 130, and a connector 140.

The outer cover 110 is fixed to the fixing plate 120 to surround the X-ray shutter apparatus 100, serves to protect inner components, and includes a path coupled to the connector fixing block 130 fixed to the fixing plate 120 and through which X-rays pass.

The fixing plate 120 is a plate to which the outer cover 110 and the connector fixing block 130 are fixed and includes a path through which the X-rays pass at a location which is the same as that of the outer cover 110.

The X-rays may be radiated through the paths included in the fixing plate 120 and the outer cover 110 when a shutter of the X-ray shutter apparatus 100 is opened.

The connector fixing block 130 may be connected to the fixing plate 120 and the connector 140 configured to supply power to solenoids 203 and optical sensors 215 may be coupled to the connector fixing block 130.

Figure 2:
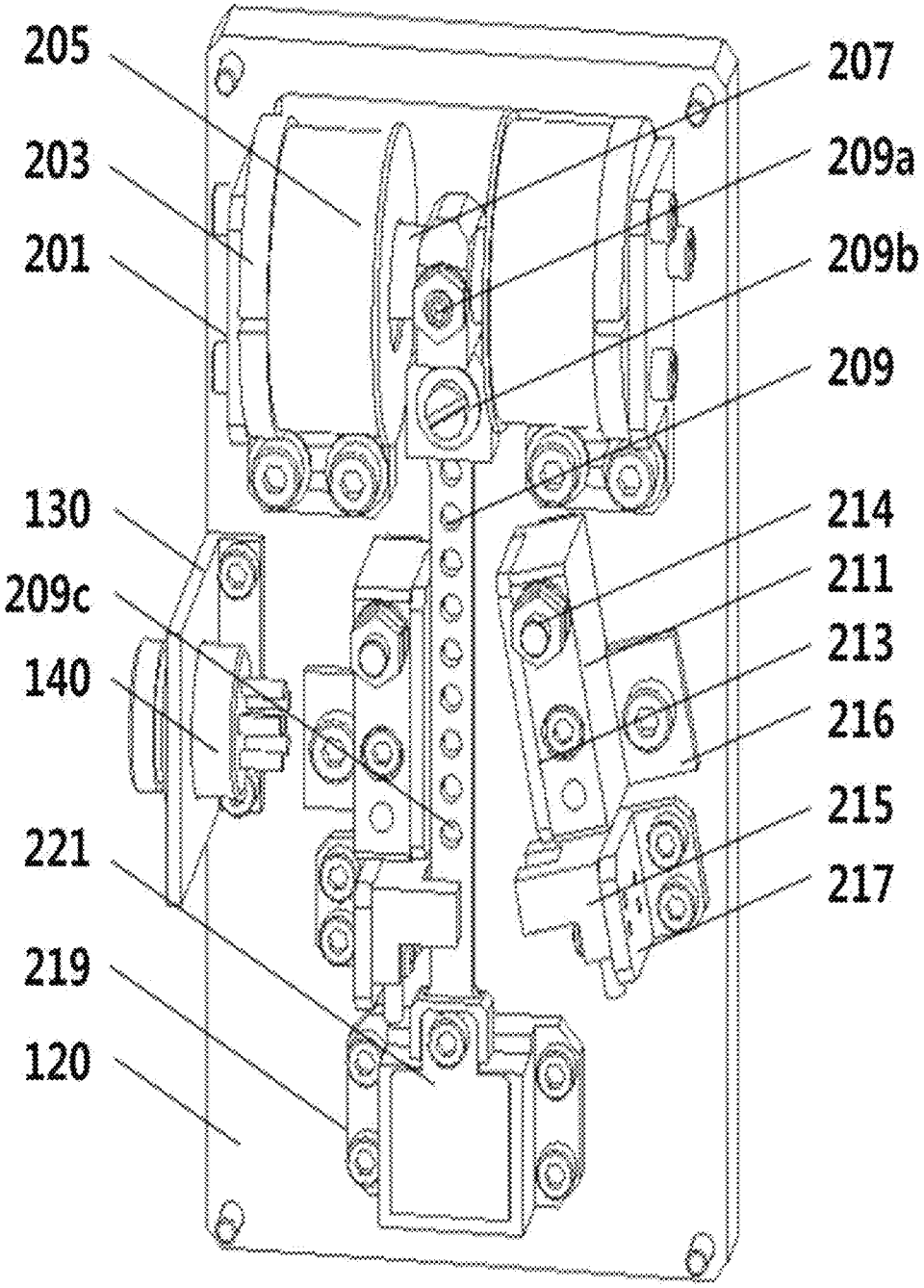
FIG. 2 is a view illustrating the inside of the X-ray shutter apparatus according to an embodiment of the present disclosure.

FIG. 2 is a view illustrating the inside of the X-ray shutter apparatus according to the embodiment of the present disclosure.

Referring to FIG. 2, solenoid fixing blocks 201, a frame 209, stop blocks 211, sensor fixing blocks 217, and an exposed block 219 may be fixedly coupled to the inside of the X-ray shutter apparatus 100 according to the embodiment of the present disclosure.

In the solenoid fixing blocks 201, for example, upper surfaces of the solenoids 203 may be coupled to inner side surfaces of both side surface portions protruding in a C shape, and an outer side surface of a middle end portion may be fixed to one surface of the fixing plate 120.

The solenoids 203 may be coupled to the solenoid fixing blocks 201 in a direction in which lower surfaces of the solenoids 203 face each other between side surface portions of the solenoid fixing blocks 201. That is, axes of the solenoids 203 may be formed in a lateral direction.

For example, each of the solenoids 203 has a cylindrical shape having a hollow hole formed therein, a coil 205 is vertically wound around the solenoid 203, and the solenoids 203 may receive currents from the connector 140 and may generate a magnetic field when the currents are supplied.

In this case, lateral and longitudinal lengths of the side surface portion of the solenoid fixing block 201 may be formed to be greater than a radius of the upper surface of the solenoid 203 so that the solenoid 203 having a cylindrical shape may be coupled to the solenoid fixing block 201 without coming into contact with the fixing plate 120.

Further, both ends of a permanent magnet 207 may be inserted into and located in holes formed in centers of the solenoids 203.

That is, one end of the permanent magnet 207 may be inserted into a first solenoid 203*a*, and the other end of the permanent magnet 207 may be inserted into a second solenoid 203*b*. Accordingly, the permanent magnet 207 may rotate in a clockwise direction or a counterclockwise direction according to a direction of the magnetic field generated from the solenoids 203.

The frame 209 may be formed of a through portion 209*a*, a coupling portion 209*b*, and a lower end portion 209*c*.

The coupling portion 209*b* may be formed at a part of the frame 209, and since the coupling portion 209*b* is fixed to one surface of the fixing plate 120, the frame 209 may be rotatably coupled to the fixing plate 120.

The through portion 209*a* is located on the coupling portion 209*b* and has a groove configured to pass through the inside thereof, and since the permanent magnet 207 is inserted into the through portion 209*a*, both ends of the permanent magnet 207 may be inserted into and located in the hollow holes formed in the solenoids 203.

The permanent magnet 207 may be laterally inserted into the through portion 209*a* to form a T shape with the frame 209.

Since a covering plate 221 is fixedly coupled to an end of the lower end portion 209*c*, the covering plate 221 may rotate together with the frame 209 when the frame 209 rotates.

Further, only the coupling portion 209*b* among the through portion 209*a*, the coupling portion 209*b*, and the lower end portion 209*c* of the frame 209 may come into contact with the fixing plate 120. The above is to reduce friction between the fixing plate 120 and the frame 209, and a shape of the frame 209 may be applied without limitation in the case in which only the coupling portion 209*b* may come into contact with the fixing plate 120.

For example, a bolt 303 is coupled to a hole formed in the coupling portion 209*b*, and thus the fixing plate 120 and the frame 209 may be coupled to the coupling portion 209*b*. Further, since a bearing 301 is coupled between the hole formed in the coupling portion 209*b* and the bolt 303, the frame 209 may rotate around the coupling portion 209*b*.

Since a groove is formed in the through portion 209*a*, the permanent magnet 207 may be seated in and coupled to the groove formed in the through portion 209*a*. Accordingly, the frame 209 may rotate together with the permanent magnet 207 when the permanent magnet 207 rotates due to the magnetic field generated from the solenoids 203. Further, the covering plate 221 may be coupled to an end of the lower end portion 209*c* and thus may rotate together with the frame 209 when the frame 209 rotates.

Since a path formed in an exposed block 219 through which the X-rays pass according to rotation of the covering plate 221 is opened and closed, the shutter of the X-ray shutter apparatus 100 may be opened and closed.

That is, the X-ray shutter apparatus 100 according to the embodiment of the present disclosure may open or close the path formed in the exposed block 219 using attraction and repulsion between the solenoids 203 and the permanent magnet 207 to minimize friction and quickly open and close the shutter.

The stop blocks 211 are fixed to one surface of the fixing plate 120 to limit a rotating radius of the frame 209 with the lower end portion 209*c* of the frame 209 therebetween, and a buffer material 213 may be attached to each of portions in which the stop blocks 211 come into contact with the lower end portion 209*c* of the frame 209 to absorb shocks due to rotation of the frame 209.

Here, locations at which the stop blocks 211 are fixed to one surface of the fixing plate are locations at which the path formed in the exposed block 219 is opened and closed by the covering plate 221 when the stop blocks 211 and the frame 209 come into contact with each other.

That is, one of the stop blocks 211 may be coupled to a location in which the path formed in the exposed block 219 is completely covered by the covering plate 221, and the other one may be fixedly coupled to a location where the path formed in the exposed block 219 starts to be completely opened when the frame 209 rotates from the location in which the path formed in the exposed block 219 is completely covered.

Accordingly, the rotating radius of the frame 209 is limited to between locations of the stop blocks 211, and a case in which the lower end portion 209*c* of the frame 209 comes into contact with the stop blocks 211 is a case in which the path formed in the exposed block 219 is completely covered by the covering plate 221 and thus the shutter is closed or a state in which the covering plate 221 completely moves away the path formed in the exposed block 219 and thus the shutter is opened.

The stop blocks 211 move by collision of the frame 209 to rotate about the center of a pin 214 and absorb a shock by a supporter 216 behind the stop block 211.

Accordingly, a rebound of the frame 209 due to a shock with the buffer material 213 in a momentary opening and closing operation of the frame 209 may be reduced, and accurate control may be performed by accurate measurement of the sensors.

The sensor fixing blocks 217 may be spaced apart from the stop blocks 211 by a predetermined distance to be fixed to the fixing plate 120, and the optical sensors 215 capable of measuring a location of the frame 209 may be coupled to the sensor fixing blocks 217.

That is, the sensor fixing blocks 217 form pairs with the stop blocks 211 and may be fixedly coupled to locations spaced apart from lower surfaces of the stop blocks by a predetermined distance on extending lines of vertical axes of the stop blocks which form the pair.

Specifically, the sensor fixing blocks 217 may be located between the lower surfaces of the stop blocks and the covering plate 221 in the case in which the stop blocks which form the pair and the lower end portion 209*c* of the frame 209 come into contact with each other.

Accordingly, the sensor fixing blocks 217 do not influence the rotating radius of the frame 209 and the optical sensors 215 may measure the location of the frame 209.

The optical sensors 215 may include an infrared sensor, an ultraviolet sensor, or a microwave sensor, and may include all means capable of measuring the location of the frame 209 without influencing the rotating radius of the frame 209.

That is, the X-ray shutter apparatus 100 according to the embodiment of the present disclosure may measure the location of the frame 209 using the optical sensors 215, which do not influence the rotating radius of the frame 209, and thus may check whether the path formed in the exposed block 219 is opened or closed, thereby accurately controlling opening and closing of the shutter.

The exposed block 219 may be coupled to one surface of the fixing plate 120, and the path formed in the exposed block 219 may be opened or closed by the covering plate 221.

The exposed block 219 may be coupled to one surface of the fixing plate 120 and may be coupled between the fixing plate 120 and the outer cover 110 so that the X-rays which pass through the fixing plate 120 may be radiated through the outer cover 110.

Figure 3:
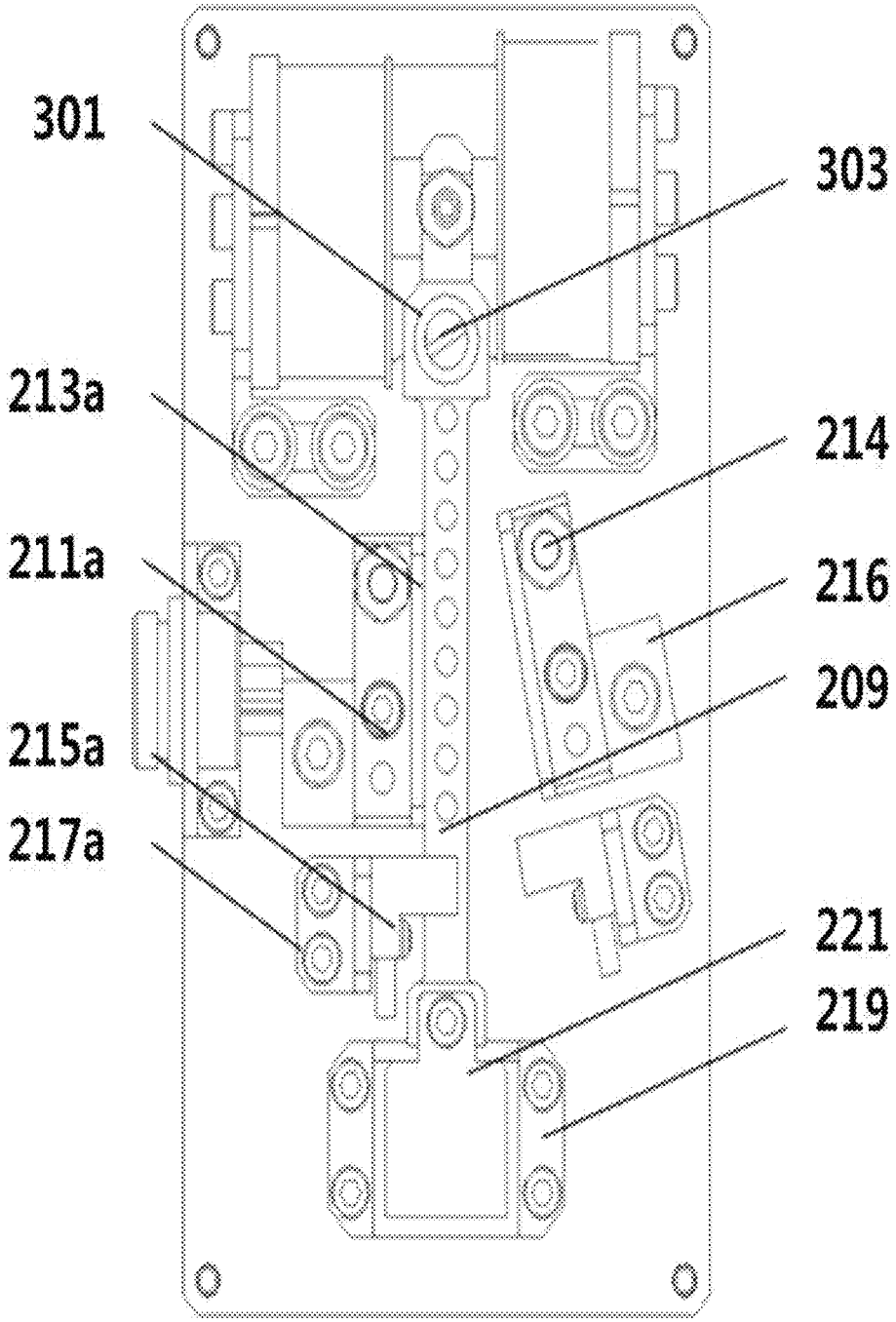
FIG. 3 is a view illustrating a state in which a shutter is closed in the X-ray shutter apparatus according to an embodiment of the present disclosure.
Figure 4:
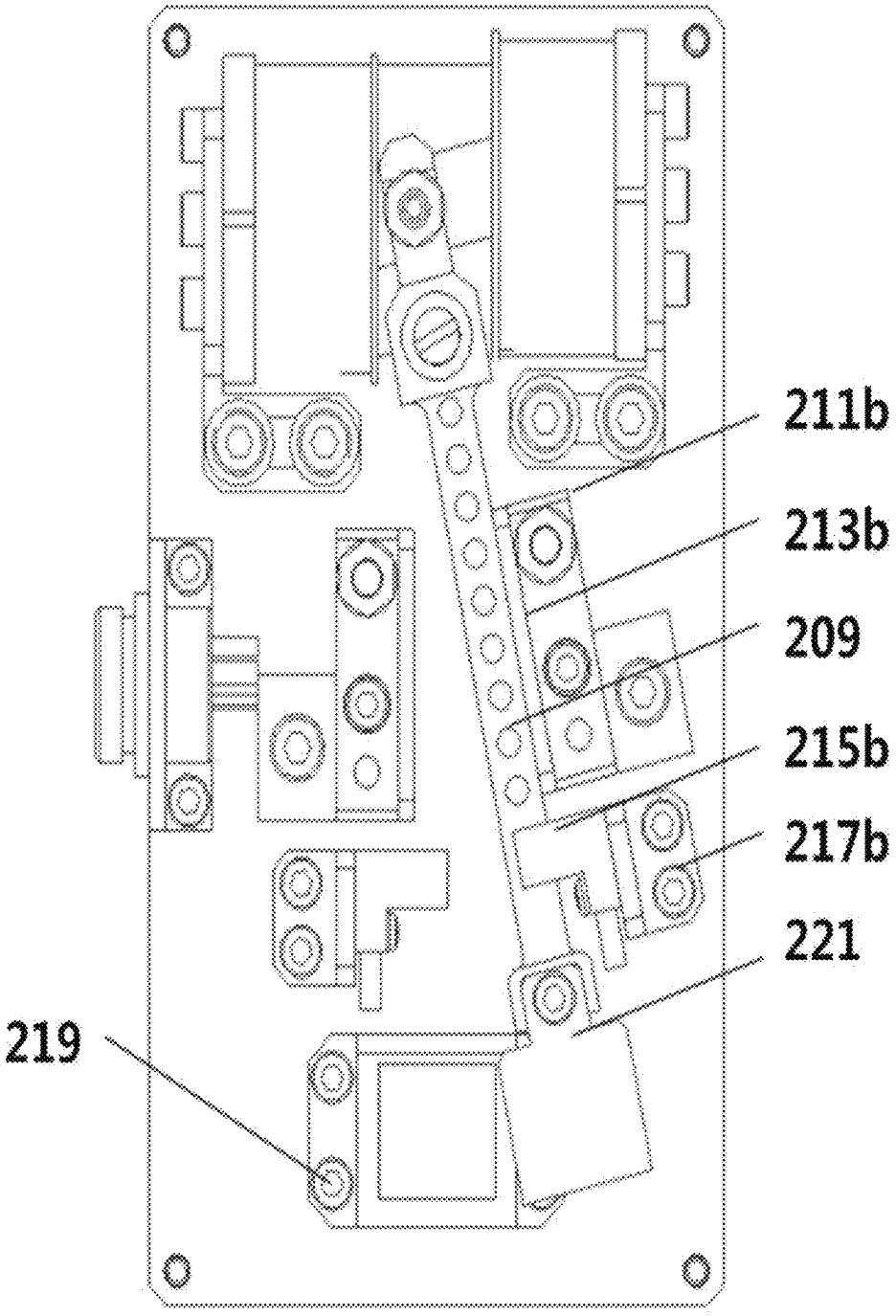
FIG. 4 is a view illustrating a state in which the shutter is opened in the X-ray shutter apparatus according to an embodiment of the present disclosure.

That is, since directions of the magnetic field generated from the solenoids 203 are opposite to each other, the permanent magnet 207 is rotated according to a direction of currents applied to the solenoids 203, and accordingly, the frame 209 and the covering plate 221 are rotated together and thus the path formed in the exposed block 219 may be opened and closed FIG. 3 is a view illustrating a state in which a shutter is closed in the X-ray shutter apparatus according to the embodiment of the present disclosure, and FIG. 4 is a view illustrating a state in which the shutter is opened in the X-ray shutter apparatus according to the embodiment of the present disclosure.

Referring to FIGS. 3 and 4, in the X-ray shutter apparatus 100, the shutter may be opened or closed according to the location between the covering plate 221 and the exposed block 219.

A case in which the shutter of the X-ray shutter apparatus 100 is closed is a case in which the lower end portion 209*c* of the frame 209 comes into contact with the first fixing block 211*a* as shown in FIG. 3, and in this case, a distance between a first optical sensor 215*a* and the lower end portion 209*c* of the frame 209 measured from the first optical sensor 215*a* may be smaller than or equal to a predetermined distance.

On the other hands, a case in which the shutter is opened is a case in which the frame 209 rotates and thus the lower end portion 209*c* of the frame 209 comes into contact with the second fixing block 211*b* as shown in FIG. 4 and is a case in which the path formed in the exposed block 219 is opened. In this case, a distance between a second optical sensor 215*b* and the lower end portion 209*c* of the frame 209 measured from the second optical sensor 215*b* may be smaller than or equal to a predetermined distance.

That is, the shutter is closed when the covering plate 221 completely covers the path formed in the exposed block 219 due to the rotation of the frame 209, and the shutter is opened when the covering plate 221 completely moves away the path formed in the exposed block 219.

The optical sensors 215 may measure a location of the lower end portion 209*c* of the frame 209, and a user may determine whether the shutter is opened or closed on the basis of the location of the frame 209 measured from the optical sensors 215.

For example, when the location of the lower end portion 209*c* of the frame 209 measured from the second optical sensor 215*b* is a location when contacting the second stop block 211*b*, that is, when a distance between the second stop block 211*b* and the lower end portion 209*c* of the frame 209 measured from the second optical sensor 215*b* is smaller than or equal to a predetermined distance, the user may determine that the shutter is completely open.

That is, the user may check whether the shutter is opened or closed through the location of the frame 209 measured from the optical sensors 215 to accurately control the opening and closing of the shutter.

Figure 5A:
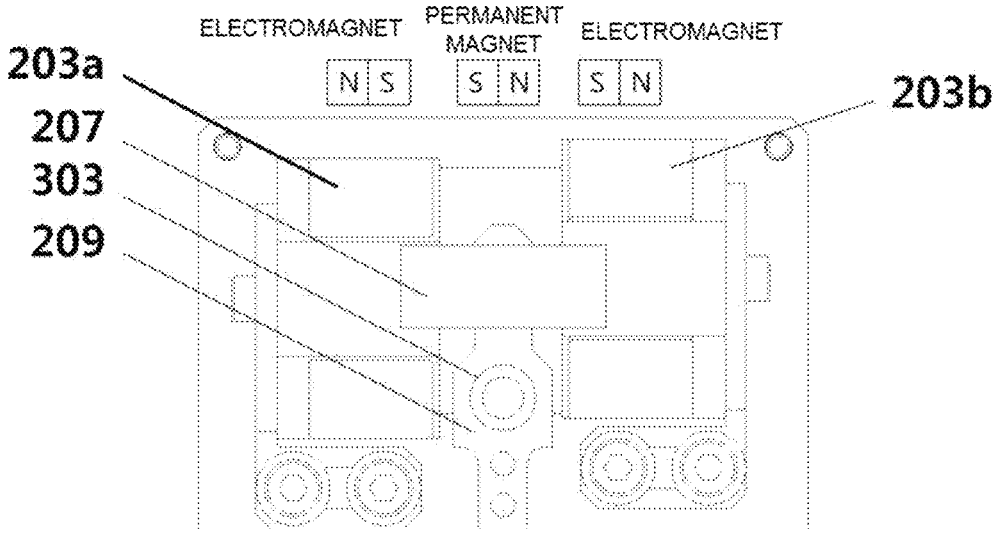
FIGS. 5A and 5B are views illustrating location variation of a permanent magnet according to whether the shutter is opened or closed in the X-ray shutter apparatus according to an embodiment of the present disclosure.
Figure 5B:
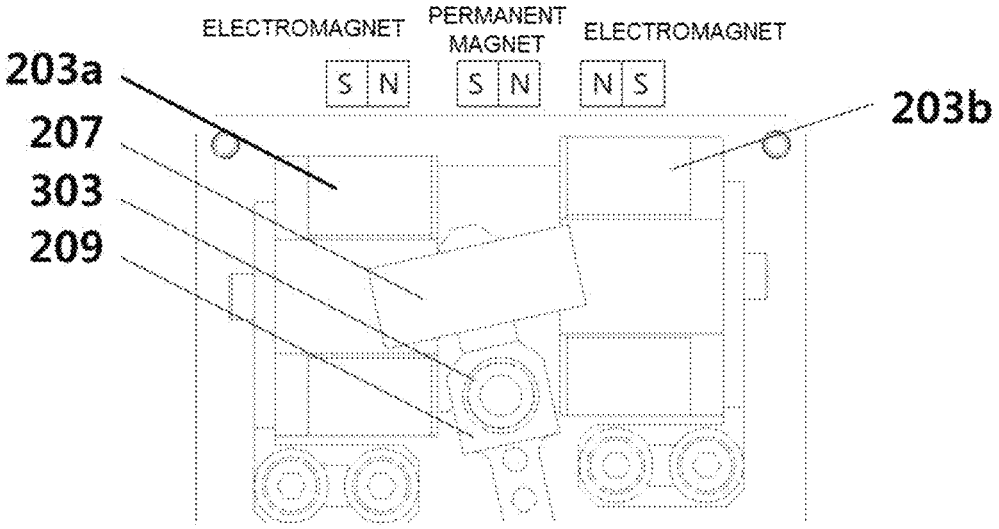

FIGS. 5A and 5B are views illustrating location variation of the permanent magnet according to whether the shutter is opened or closed in the X-ray shutter apparatus according to the embodiment of the present disclosure.

Specifically, FIG. 5A is a view of a case in which the repulsion acts because the direction of the magnetic field of the first solenoid 203*a* and a direction of a magnetic field of the permanent magnet 207 are different and the attraction acts because the direction of the magnetic field of the second solenoid 203*b* and the direction of the magnetic field of the permanent magnet 207 are the same, and FIG. 5B is a view of a case in which the attraction acts because the direction of the magnetic field of the first solenoid 203*a* and the direction of the magnetic field of the permanent magnet 207 are the same and the repulsion acts because the direction of the magnetic field of the second solenoid 203*b* and the direction of the magnetic field of the permanent magnet 207 are different.

Referring to FIGS. 5A and 5B, since the attraction and repulsion act between the solenoids 203 and the permanent magnet 207, the permanent magnet 207 may rotate in the clockwise direction around the fixing bolt 303 coupled to the coupling portion 209*b* of the direction frame 209.

In this case, the frame 209 may rotate together with the permanent magnet 207 when the permanent magnet 207 rotates, and the covering plate 221 coupled to the lower end portion 209*c* of the frame 209 may rotate together with the frame 209 due to rotation of the frame 209.

For example, as shown in FIG. 5A, when the repulsion acts between the first solenoid 203*a* and the permanent magnet 207 and the attraction acts between the second solenoid 203*b* and the permanent magnet 207 and thus the covering plate 221 rotates in the clockwise direction, since the path formed in the exposed block 219 is covered by the covering plate 221, the shutter may be closed and the X-rays may not pass through the X-ray shutter apparatus 100.

On the other hands, as shown in FIG. 5B, when the attraction acts between the first solenoid 203*a* and the permanent magnet 207 and the repulsion acts between the second solenoid 203*b* and the permanent magnet 207 and thus the covering plate 221 rotates in the counterclockwise direction and does not cover the path formed in the exposed block 219, the shutter may be opened and the X-rays may pass through the X-ray shutter apparatus 100.

Figure 6A:
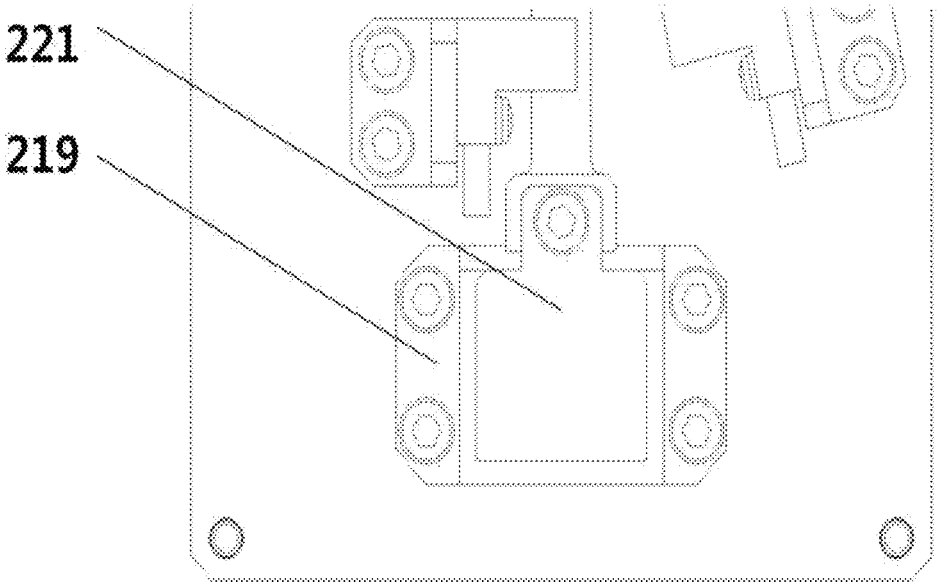
FIGS. 6A and 6B are views illustrating location variation of a cover film according to whether the shutter is opened or closed in the X-ray shutter apparatus according to an embodiment of the present disclosure.
Figure 6B:
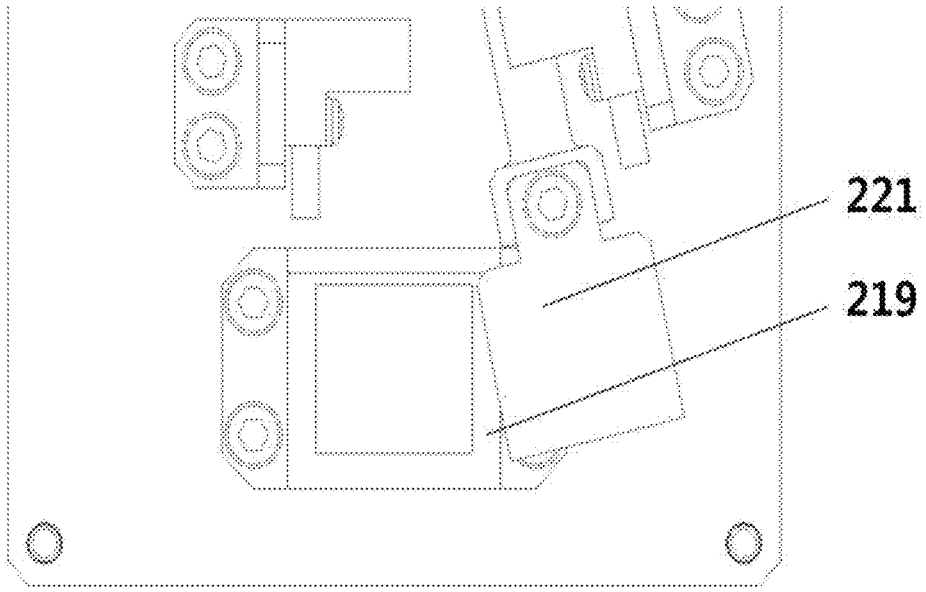

FIGS. 6A and 6B are views illustrating location variation of the cover plate according to whether the shutter is opened or closed in the X-ray shutter apparatus according to the embodiment of the present disclosure.

Specifically, FIG. 6A is a view illustrating the state in which the shutter is closed and FIG. 6B is a view illustrating the state in which the shutter is opened.

Referring to FIGS. 6A and 6B, as shown in FIG. 6A, when the frame 209 rotates in the clockwise direction and comes into contact with the first stop block 211*a*, since the covering plate 221 completely covers the path formed in the exposed block 219, the shutter of the X-ray shutter apparatus 100 may be closed.

On the other hands, as shown in FIG. 6B, when the frame 209 rotates in the counterclockwise direction and comes into contact with the second stop block 211*b*, since the covering plate 221 moves away the path formed in the exposed block 219 and thus the path formed in the exposed block 219 is completely opened, the shutter of the X-ray shutter apparatus 100 may be opened.

Figure 7A:
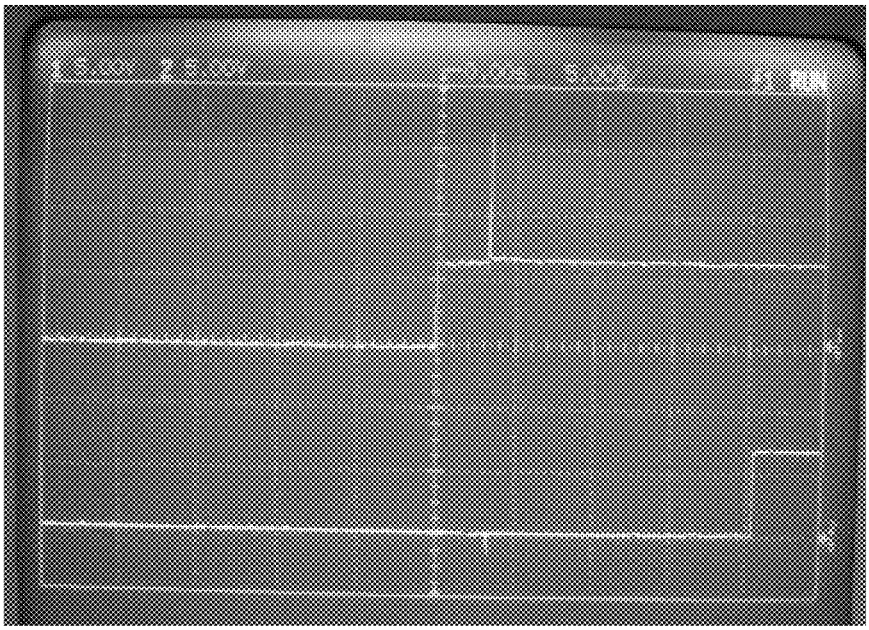
FIG. 7A is test data in which an opening time of a shutter is measured according to an embodiment of the present disclosure.
Figure 7B:
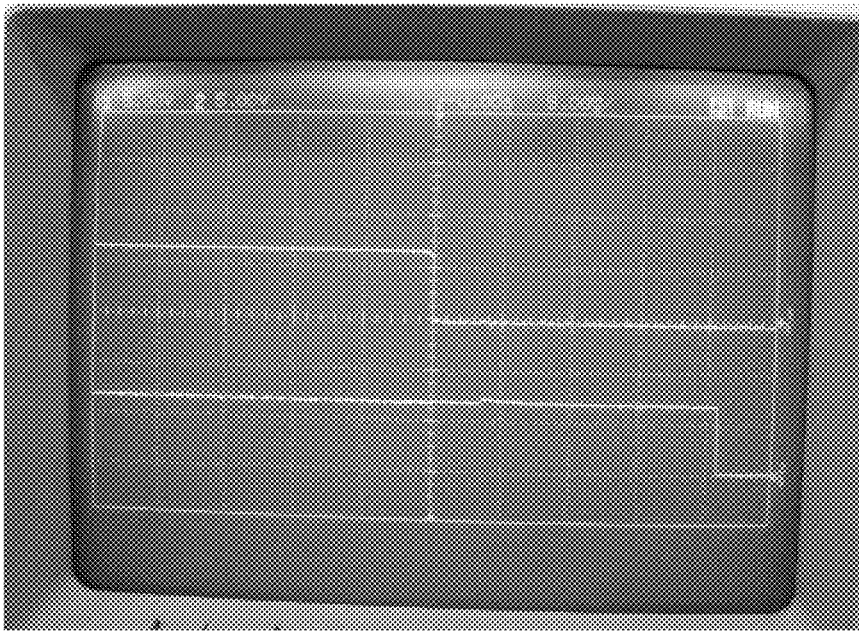
FIG. 7B is test data in which a closing time of a shutter is measured according to an embodiment of the present disclosure.

FIGS. 7A and 7B are test data in which an opening and closing time of the shutter is measured in the X-ray shutter apparatus according to the embodiment of the present disclosure.

Specifically, FIG. 7A is test data in which the opening time of the shutter is measured and FIG. 7B is test data in which the closing time of the shutter is measured.

Referring to FIGS. 7A and 7B, according to a result of repeatedly measuring a time taken for opening and closing the shutter, a time taken to completely open the shutter after applying an opening signal of the shutter was measured to be 21 ms, and, on the other hands, a time taken to completely close the shutter after applying a closing signal of the shutter was also measured to be 21 ms.

The opening time of the shutter is a time taken until the closed shutter is opened and is a time taken until the frame 209 rotates in the counterclockwise direction to come into contact with the second stop block 211*b* and thus the path formed in the exposed block 219 is completely opened from a state in which the frame 209 comes into contact with the first stop block 211*a* and the covering plate 221 completely covers the path formed in the exposed block 219.

On the other hands, the closing time of the shutter is a time taken until the opened shutter is closed and is a time taken until the frame 209 rotates in the clockwise direction to come into contact with the first stop block 211*a* and thus the covering plate 221 completely covers the path formed in the exposed block 219 from a state in which the frame 209 comes into contact with the second stop block 211*b* and the covering plate 221 completely moves away the path formed in the exposed block 219.

That is, the X-ray shutter apparatus 100 according to the embodiment of the present disclosure may open or close the shutter through rotating movement using the magnetic field between the solenoids 203 and the permanent magnet 207 and thus may increase the opening speed or the closing speed of the shutter by minimizing physical friction.

Further, since the location of the frame 209 is measured by the optical sensors 215, the opening or the closing of the shutter may be accurately controlled.

The X-ray shutter opening and closing system according to the embodiment of the present disclosure may include the X-ray shutter apparatus and a controller.

The controller may be located at the outside of the X-ray shutter apparatus 100 and may adjust a direction of currents applied to the X-ray shutter apparatus 100 according to a signal which is input.

For example, when the controller receives an opening signal of the path formed in the exposed block 219, that is, an opening signal of the shutter, the controller may adjust the direction of the currents applied to the X-ray shutter apparatus 100 so that the shutter may be opened.

For example, since the attraction between the first solenoid 203*a* and the permanent magnet 207 and the repulsion acts between the second solenoid 203*b* and the permanent magnet 207 and thus the permanent magnet 207 rotates in the counterclockwise direction, the path formed in the exposed block 219, that is, the shutter may be opened.

On the other hands, when the controller receives a closing signal of the path formed in the exposed block 219, that is, a closing signal of the shutter, the controller may adjust the direction of the currents applied to the X-ray shutter apparatus 100 so that the shutter may be closed.

Further, the controller may determine whether the path formed in the exposed block 219 is opened or closed on the basis of the direction of the currents applied to the X-ray shutter apparatus 100 and the distances between the frame 209 and the optical sensors 215 measured by the optical sensors 215 located in the X-ray shutter apparatus 100.

For example, when the direction of the currents applied to the X-ray shutter apparatus 100 is a direction for opening the path formed in the exposed block 219, the controller may determine that the path formed in the exposed block 219 is opened and thus the shutter of the X-ray shutter apparatus 100 is opened in the case in which the distance between the frame 209 and the second optical sensor 215*b* measured by the second optical sensor 215*b* is smaller than or equal to a predetermined distance.

That is, the controller may determine that the path formed in the exposed block 219 is opened and thus the shutter of the X-ray shutter apparatus 100 is opened when the distance between the frame 209 and the second optical sensor 215*b* measured by the second optical sensor 215*b* closer to the frame 209 in the case in which the path formed in the exposed block 219 is opened among the optical sensors is smaller than or equal to the predetermined distance.

Here, the predetermined distance is the distances between the optical sensor 215 closer to the stop block 211 which comes into contact with the frame 209 among the optical sensors 215 and the frame 209 when the lower end portion 209*c* of the frame 209 comes into contact with one of the stop blocks 211.

On the other hands, when the direction of the currents applied to the X-ray shutter apparatus 100 is a direction for closing the path formed in the exposed block 219, the controller may determine that the path formed in the exposed block 219 is closed and thus the shutter of the X-ray shutter apparatus 100 is closed in the case in which the distance between the frame 209 and the first optical sensor 215*a* measured by the first optical sensor 215*a* is smaller than or equal to a predetermined distance.

In an X-ray shutter apparatus according to an embodiment of the present disclosure and an X-ray shutter opening and closing system using the same, since a frame is rotated using a magnetic field generated from solenoids and thus mechanical friction is minimized, a path through which X-rays pass can be quickly opened and closed.

Further, an opening and closing state can be accurately controlled by measuring a location of the rotating frame using optical sensors.

Descriptions in the specification are shown as some examples but may be variously changed or modified by the scope defined by claims which will be described below, and the technical scope of the present disclosure should be defined by the claims.

What is claimed is:

1. An X-ray shutter apparatus comprising:

a fixing plate;

a solenoid fixing block in which upper surfaces of solenoids formed in a cylindrical shape having a hollow hole formed therein are coupled to inner side surfaces of both side surface portions spaced apart from each other and protruding in a C shape, and an outer side surface of a middle end portion is fixed to one surface of the fixing plate;

a frame in which a coupling portion formed at a part of the frame is fixed to the one surface of the fixing plate to be rotatably coupled to the fixing plate, a through portion in which a groove configured to pass through the inside thereof is formed is located on the coupling portion, and a covering plate is fixedly coupled to an end of a lower end portion;

a permanent magnet inserted into the through portion to be seated in the groove and having both ends inserted into the hollow holes formed in the solenoids;

a plurality of stop blocks fixedly coupled to the one surface of the fixing plate at locations spaced apart from each other with the lower end portion of the frame therebetween; and an exposed block fixed to the one surface of the fixing plate and in which a path is opened and closed by the covering plate when the frame rotates.

2. The X-ray shutter apparatus of claim 1, wherein:

the permanent magnet is laterally inserted into the through portion; and the frame and the permanent magnet form a T shape.

3. The X-ray shutter apparatus of claim 1, wherein only the coupling portion among the through portion, the coupling portion, and the lower end portion of the frame comes into contact with the fixing plate.

4. The X-ray shutter apparatus of claim 1, wherein the solenoids each have a lateral axial direction and are coupled to the solenoid fixing block so that lower surfaces thereof face each other.

5. The X-ray shutter apparatus of claim 1, wherein the frame has a bolt coupled to a hole formed in the coupling portion and thus is rotatably coupled to the one surface of the fixing plate.

6. The X-ray shutter apparatus of claim 1, wherein X-rays pass through the path when the path formed in the exposed block is opened.

7. The X-ray shutter apparatus of claim 1, wherein the stop blocks each include a buffer material attached to a portion which comes into contact with the frame configured to rotate between the stop blocks.

8. The X-ray shutter apparatus of claim 1, further comprising sensor fixing blocks forming pairs with the stop blocks and fixedly coupled to the fixing plate at locations spaced apart from lower surfaces of the stop blocks by a predetermined distance on extending lines of vertical axes of the stop blocks which form the pair.

9. The X-ray shutter apparatus of claim 8, wherein the sensor fixing blocks are located between the covering plate and the lower surfaces of the stop blocks in the case in which the frame comes into contact with the stop blocks which form the pair.

10. The X-ray shutter apparatus of claim 8, wherein optical sensors configured to measure distances between the lower end portion of the frame and the sensor fixing blocks are coupled to each of the sensor fixing blocks.

11. An X-ray shutter opening and closing system comprising:

the X-ray shutter apparatus of claim 8; and a controller configured to adjust a direction of currents applied to the solenoids according to a signal which is input and determine whether the path formed in the exposed block is opened or closed on the basis of the direction of the currents and distances between optical sensors and the frame measured by the optical sensors.

12. The X-ray shutter opening and closing system of claim 11, wherein the controller adjusts the direction of the currents applied to the solenoids to open or close the path formed in the exposed block when an opening signal or a closing signal of the path formed in the exposed block is received.

13. The X-ray shutter opening and closing system of claim 11, wherein the controller determines that the path formed in the exposed block is opened when the direction of the currents applied to the solenoids is a direction to open the path formed in the exposed block and the distances between the optical sensors and the frame measured by the optical sensor closer to the frame in the case in which the path formed in the exposed block is opened among the optical sensors are smaller than or equal to a predetermined distance.

14. The X-ray shutter opening and closing system of claim 11, wherein the controller determines that the path formed in the exposed block is closed when the direction of the currents applied to the solenoids is a direction to close the path formed in the exposed block and the distances between the optical sensors and the frame measured by the optical sensor closer to the frame in the case in which the path formed in the exposed block is closed among the optical sensors are smaller than or equal to a predetermined distance.

15. The X-ray shutter opening and closing system of claim 13, wherein the predetermined distance is a distance between the optical sensor closer to the stop block which comes into contact with the frame among the optical sensors and the frame when the lower end portion of the frame comes into contact with one of the stop blocks.

16. The X-ray shutter opening and closing system of claim 14, wherein the predetermined distance is a distance between the optical sensor closer to the stop block which comes into contact with the frame among the optical sensors and the frame when the lower end portion of the frame comes into contact with one of the stop blocks.

17. The X-ray shutter apparatus of claim 1, further comprising a connector fixing block fixedly coupled to the one surface of the fixing plate and to which a connector configured to supply external power to the fixing plate is connected.

18. The X-ray shutter apparatus of claim 1, wherein the frame rotates together with the permanent magnet when the permanent magnet rotates due to a magnetic field generated when currents flow through the solenoids.

19. The X-ray shutter apparatus of claim 1, wherein the frame rotates in a clockwise direction or a counterclockwise direction according to a direction in which currents flow through the solenoids.

20. The X-ray shutter apparatus of claim 1, wherein directions of currents which flow through the solenoids are opposite to each other.

* * * * *